United States Patent [19]

Purifoy, Jr.

[11] Patent Number: 4,640,215

[45] Date of Patent: Feb. 3, 1987

[54] CONVERSION ADAPTER FOR BUOYANCY COMPENSATOR VEST

[76] Inventor: George G. Purifoy, Jr., 206 Lockwood Dr., Morehead City, N.C. 28557

[21] Appl. No.: 824,639

[22] Filed: Jan. 31, 1986

[51] Int. Cl.[4] ..... B63C 11/46

[52] U.S. Cl. ..... 114/315; 128/205.22; 224/211

[58] Field of Search ..... 114/315, 317; 128/201.27, 202.14, 205.15, 205.22; 224/210-212, 225, 227, 246, 259; 405/186

[56] References Cited

U.S. PATENT DOCUMENTS 3,191,828 6/1965 Senne ..... 224/211
3,269,129 8/1966 Zambrano ..... 224/211
3,842,611 10/1974 Anderson ..... 114/315
4,383,528 5/1983 Eppolito ..... 128/205.22

*Primary Examiner*—Trygve M. Blix
*Assistant Examiner*—Jesûs D. Sotelo
*Attorney, Agent, or Firm*—Mills & Coats

[57] ABSTRACT

This invention is an adapter for a diver's buoyancy compensator vest which allows conversion from a single tank to a double tank configuration to be quickly and readily made. The adapter includes a pair of elongated rod-like members with tank locking wedges mounted on the end thereof with wing nuts. The conversion back to a single tank can be readily accomplished by simply disconnecting the adapter and removing the same from the vest.

10 Claims, 6 Drawing Figures

CONVERSION ADAPTER FOR BUOYANCY COMPENSATOR VEST

FIELD OF INVENTION

This invention relates to diving equipment and more particularly to adapters for converting a single tank buoyancy compensation vest to a double tank vest.

BACKGROUND OF INVENTION

Buoyancy compensator vests are well known to those skilled in the art, are commercially available, and are standard diving equipment. The single tank vest includes provisions for an air tank including a concave mounting member with associated securing straps.

When it is desirable to remain under water for an extended period of time thereby requiring dual tanks, either a second double tank vest must be purchased and stored when not in use, or conversion must be made which takes at least fifteen to twenty minutes to accomplish. Since storage space on boats, particularly diving boats, is usually limited, the carrying of two different sets of vests is undesirable. Likewise, the carrying of a single type of vest with the great amount of time required for conversion presents an undesirable alternative.

After much research and study into the above mentioned problems, the present invention has been developed to provide a double tank adapter for buoyancy compensator vests which allows the user thereof to convert from a single tank to double tanks in less than two minutes. This adapter, formed from corrosion resistant materials, likewise allows the compensator vest to be converted back to a single tank with ease.

The above is accomplished through the provision of a base plate which bolts to the back of the buoyance compensator vest designed for a single tank. Elongated, rod-like members outwardly project from the base plate and terminate in a threaded portion which, through the use of locking wedges and wing nuts, allow the conversion to be quickly and easily made.

In view of the above it is an object of the present invention to provide a conversion adapter for single tank buoyancy compensator vests whereby double tanks can be readily mounted thereon.

Another object of the present invention is to provide a conversion adapter for single tank buoyancy compensator vests to allow double tanks to be used in conjunction therewith.

Another object of the present invention is to provide, in a single to double tank adapter for buoyancy compensator vests, locking means for readily securing the tanks in place.

Another object of the present invention is to provide, in a single to double tank conversion means for buoyancy compensator vests, a base plate which readily attaches to said vest tank.

Another object of the present invention is to provide, in connection with buoyance compensator vests, a means for readily converting from a single tank to double tanks and vice versa with a minimum of effort and time involved.

Other objects and advantages of the present invention will become apparent and obvious from a study of the following description and the accompanying drawings which are merely illustrative of such invention.

DETAILED DESCRIPTION OF INVENTION

Figure 1:
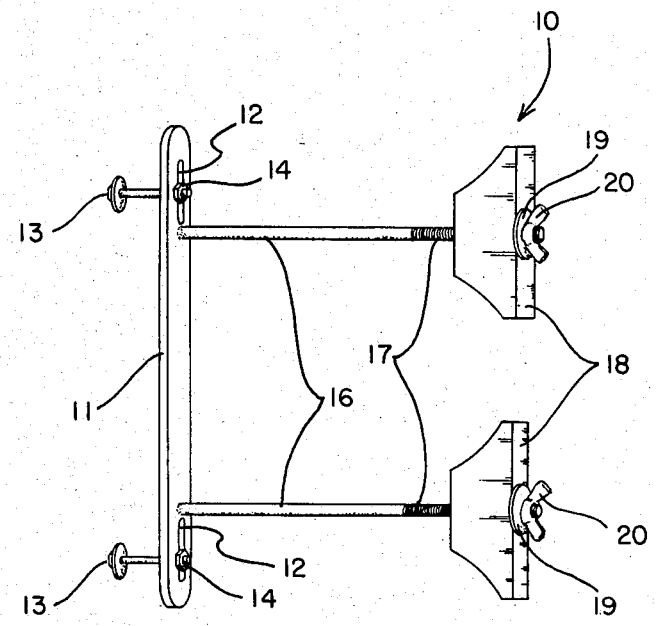
FIG. 1 is a perspective view of the conversion adapter of the present invention.
Figure 2:
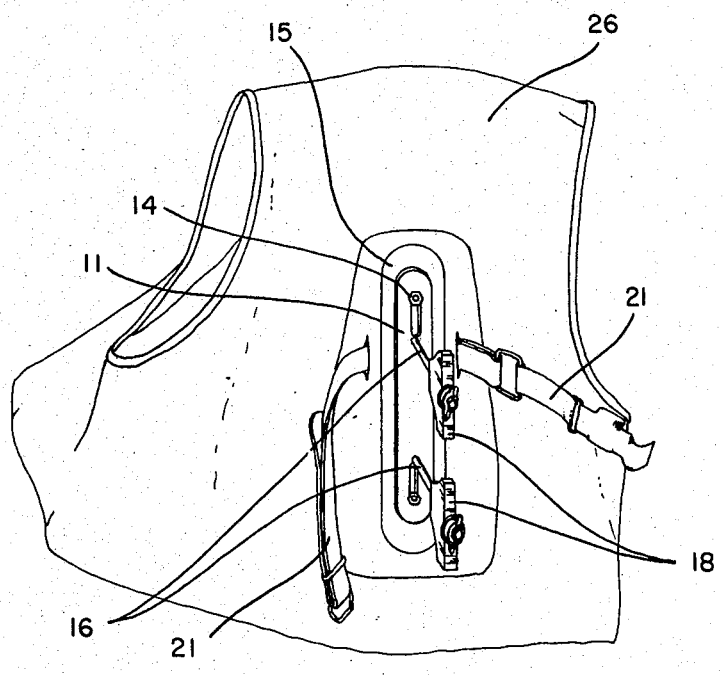
FIG. 2 is a perspective view of the conversion adapter mounted on a buoyancy compensator vest.
Figure 3:
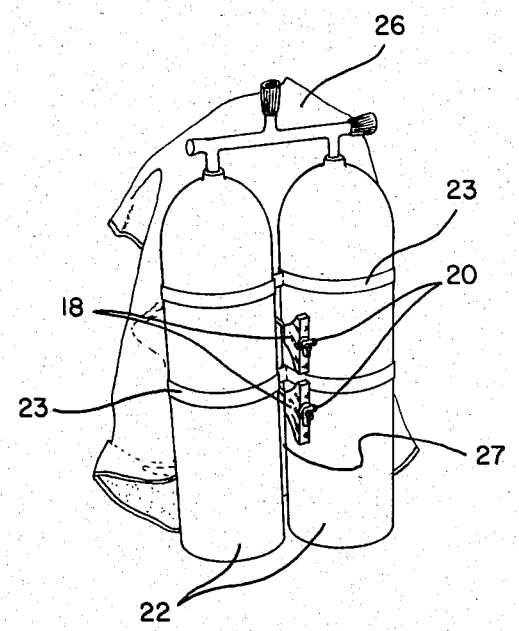
FIG. 3 is a perspective view of double tanks being mounted on the conversion adapter.
Figure 4:
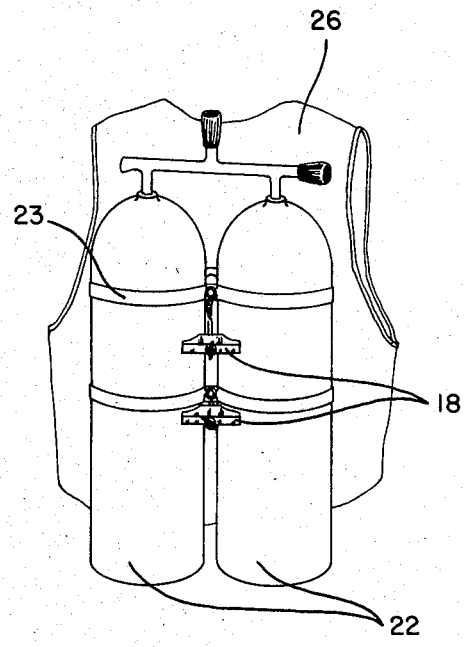
FIG. 4 is a perspective view of double tanks mounted on a buoyancy compensator vest designed for a single tank utilizing the conversion adapter of the present invention.
Figure 5:
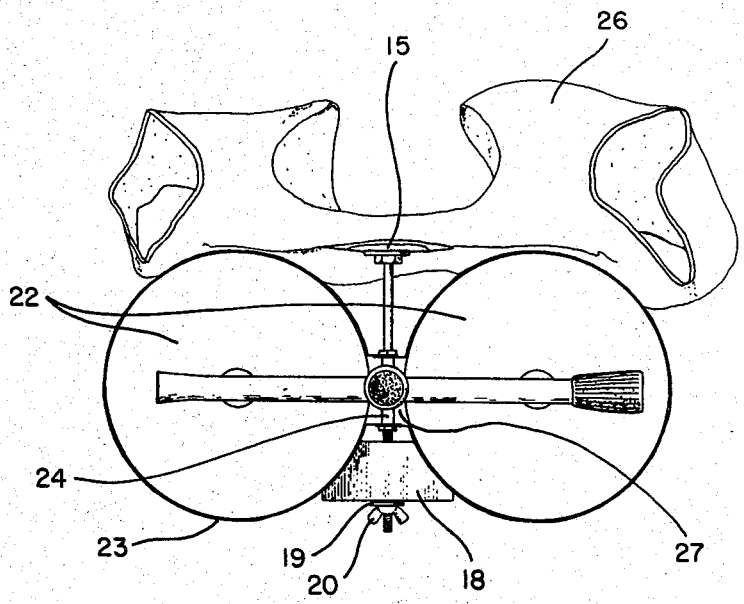
FIG. 5 is a top plan view of the conversion adapter in use.

With further reference to the drawings, the conversion adapter of the present invention, indicated generally at 10, includes an elongated base plate 11. This base plate includes a pair of longitudinally disposed, elongated slots 12 adjacent each end thereof.

A vest securing means such as bolts 13 and associated nuts 14 are adapted to pass through openings in the single tank mounting base 15 of the compensator vest 26.

A pair of outwardly extending, rod-like members 16 are secured by weldment or similar means to base plate 11. The outer end of rods 16 are threaded as indicated at 17.

A somewhat trapezoidal shaped locking wedge 18 having a central opening therein is adapted to be slidingly mounted on each of the rods 16. Washers 19 are mounted on the outside of each of the locking wedges 18 and wing nuts are adapted to be mounted on the threaded portion 17 of said rods for use in the normal manner of such devices.

To use the conversion adapter of the present invention, the single tank (not shown) which is normally mounted against base 15 and held in place by mounting straps 21 is removed and base plate 11 is secured thereto by means such as nuts and bolts 13 and 14.

Next double tanks 22, which are held together in the normal manner by straps or bands 23 and their associated means 24, are disposed adjacent the conversion adapter 10 of the present invention with rods 16 being disposed between said tanks.

The locking wedges 18 are mounted transversely to said tanks 22 on rods 16 so that their curved edges 18' will wedgingly engage said tanks. With the washers 19 disposed between the wedges 18 and wing nuts 20, said wing nuts can be easily threaded down on rod 16 until such locking wedges 18 tightly secure the tanks in place.

Thus it can be seen that through use of the conversion adapter 10 of the present invention, double tanks 22 can be quickly and readily mounted on a buoyancy compensator vest 26 that was originally designed to be used in conjunction with a single tank.

Whenever it is desirable to remove the double tanks 22 from vest 26 and return to single tank mounting, wing nuts 20 can be loosened enough to allow the tranversely disposed locking wedges 18 to be pivoted ninety degrees or parallel to the opening 27 between tanks 22. The tanks can then be removed from the conversion adapter 10. Next the vest securing means 13 and 14 can be released thus returning the compensator vest 26 to its original one tank configuration. A single tank (not shown) can then be mounted thereon in the normal manner.

Figure 6:
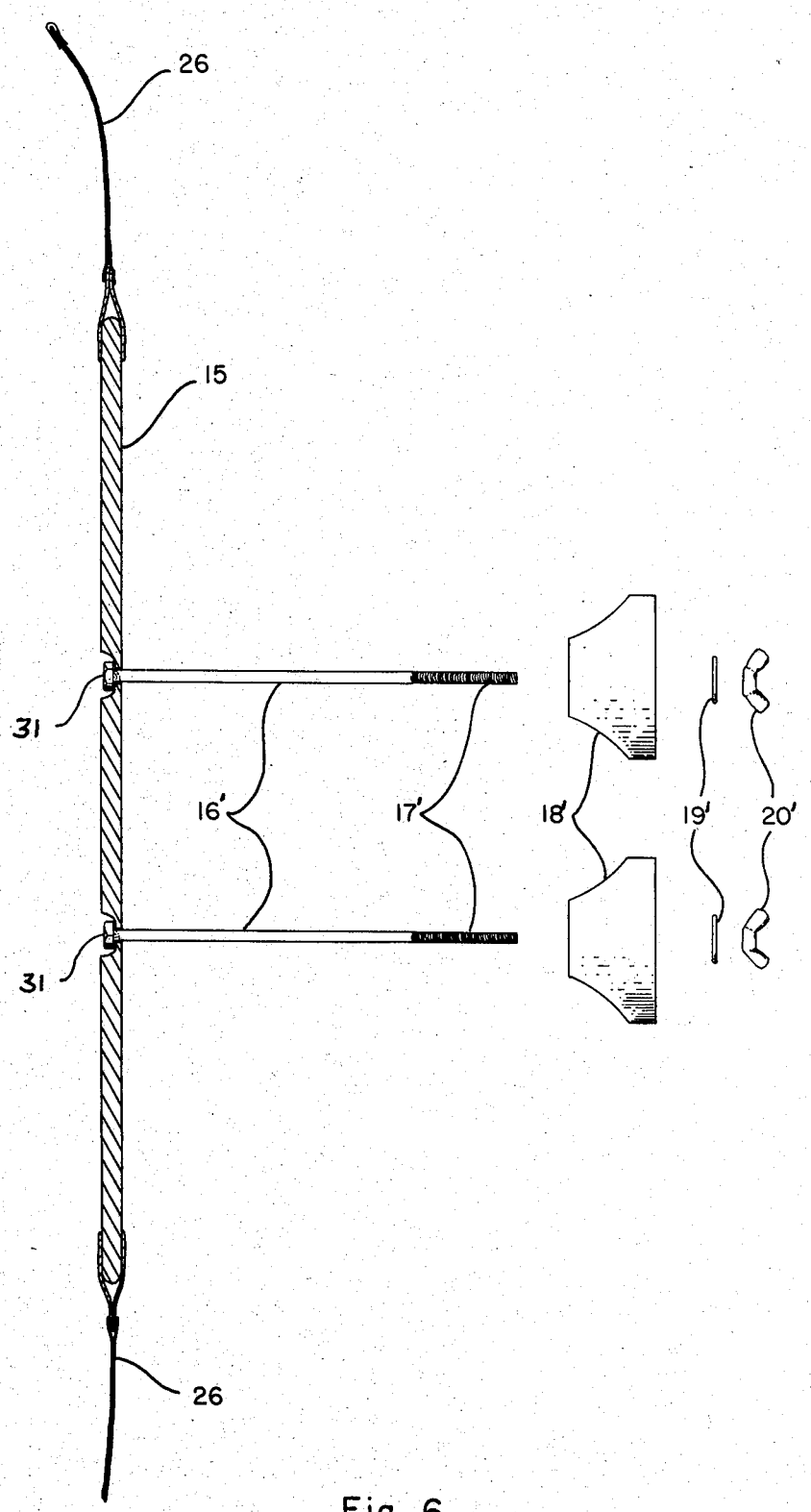
FIG. 6 is an elevational view of a modification of the present invention.

The modification of the present invention shown in FIG. 6 utilizes the normal openings in the single tank mounting base 15 of vest 26 through which the bolts 13 pass when utilizing the base plate 11. These openings receive elongated bolt like rods 16' which include a bolt head 31 at one end and a threaded portion 17' at the other end. Otherwise the locking wedges 18', the washers 19' and the wing nuts 20' all function in the same manner as herein above described for the adaptor utilizing the base plate 11.

From the above it can be seen that the present invention has the advantage of providing a simple, inexpensive means of converting a single tank buoyancy compensator vest to a double tank vest. The conversion from single to double tanks and back is readily accomplished with a minimum of time and effort involved and yet a very stable and secure attachment is provided.

The present invention can, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. In a buoyancy compensator vest having a single tank mounting base, the improvement comprising: a two tank conversion adapter including a base plate; securing means for mounting said base plate on said single tank mounting base; elongated, rod-like members secured to and outwardly extending from said base plate; a pair of spaced, interconnected tanks mounted on either side of said rod-like members; wedge means mounted on the outer end of said rod-like members for engaging said tanks; and means for releasably tightening said wedge means against said pair of interconnected tanks whereby a buoyancy compensator vest designed for use in conjunction with a single tank can be readily converted to mount interconnected double tanks.

2. The tank conversion adapter of claim 1 wherein the same is formed from corrosion resistant materials.

3. The tank conversion adapter of claim 1 wherein said wedge means have a generally trapezoidal configuration.

4. The tank conversion adapter of claim 1 wherein said means for releasably tightening said wedge means against said tanks are wing nut means threaded onto the end of said rod-like members.

5. The tank conversion adapter of claim 1 wherein the means for securing said base plate to said single tank mounting base are bolt and nut means.

6. The tank conversion adapter of claim 5 wherein said bolt means pass through an elongated slot in said base plate.

7. In a buoyancy compensator vest having a single tank mounting base with openings passing therethrough, the improvement comprising: at least two elongated, rod-like members passing through said openings in said mounting base and outwardly extending therefrom; a pair of spaced, interconnected tanks mounted on either side of said rod-like members, wedge means mounted on the outer end of said rod-like members from said mounting base for engaging said tank, and means for releasably tightening said wedge means against said pair of interconnected tanks whereby a buoyancy compensator vest designed for use in conjunction with a single tank can be readily converted to mount interconnected double tanks.

8. The tank conversion adapter of claim 7 wherein the same is formed from corrosion resistant materials.

9. The tank conversion adapter of claim 7 wherein said wedge means have a generally trapezoidal configuration.

10. The tank conversion adapter of claim 7 wherein said means for releasably tightening said wedge means against said tanks are wing nut means threaded onto the outer end of said rod-like members.

* * * * *